US006471589B1

(12) United States Patent
Nagano

(10) Patent No.: US 6,471,589 B1
(45) Date of Patent: Oct. 29, 2002

(54) GAME MACHINE HAVING INDIVIDUAL DIFFERENCE IN SAME MACHINE KIND

(75) Inventor: Hiroyuki Nagano, Tokyo (JP)

(73) Assignee: Aruze Corporation, Tokyo (JP)

( * ) Notice: Subject to any disclaimer, the term of this patent is extended or adjusted under 35 U.S.C. 154(b) by 0 days.

(21) Appl. No.: 09/533,733

(22) Filed: Mar. 23, 2000

(30) Foreign Application Priority Data

Mar. 23, 1999 (JP) ..... 11-077115

(51) Int. Cl.[7] ..... A63F 9/22

(52) U.S. Cl. ..... 463/21; 463/20; 463/22; 273/143 R

(58) Field of Search ..... 463/16–22; 273/143 R

(56) References Cited

U.S. PATENT DOCUMENTS

| | | | | | |
|---|---|---|---|---|---|
| 5,108,099 | A | * | 4/1992 | Smyth | 273/138 A |
| 5,169,147 | A | * | 12/1992 | Hamano | 273/138 A |
| 5,178,390 | A | * | 1/1993 | Okada | 273/143 R |
| 5,472,197 | A | | 12/1995 | Gwiasda et al. | |
| 5,741,183 | A | * | 4/1998 | Acres et al. | 463/42 |
| 6,068,552 | A | * | 5/2000 | Walker et al. | 463/21 |
| 6,110,041 | A | * | 8/2000 | Walker et al. | 463/20 |
| 6,203,429 | B1 | * | 3/2001 | Demar et al. | 463/20 |
| 6,264,561 | B1 | * | 7/2001 | Saffari et al. | 463/42 |

FOREIGN PATENT DOCUMENTS

| | | |
|---|---|---|
| DE | 196 25 293 | 1/1998 |
| GB | 2 091 014 | 7/1982 |
| JP | 6-198041 | 7/1994 |

* cited by examiner

*Primary Examiner*—Michael O'Neill
*Assistant Examiner*—Carmen D. White
(74) *Attorney, Agent, or Firm*—Pillsbury Winthrop LLP

(57) ABSTRACT

Conventionally, the same impression is given by machine bodies of the same kind even when any of them is played and attachment or preference of a player with regard to a machine or a game is difficult to produce. Therefore, a slot machine (1) according to the invention is provided with control means changing control of an attached equipment by individuals of the game machines such that individual difference is produced among the game machines of the same machine kind without changing control of hit probability. When the attached equipment is constituted by reels (3) through (5), the ROM (32) stores control constants for determining a timing of starting to rotate or stopping to rotate the respective reels (3) through (5) by values which differ depending on the individuals.

6 Claims, 3 Drawing Sheets

GAME MACHINE HAVING INDIVIDUAL DIFFERENCE IN SAME MACHINE KIND

This patent application claims priority based on the Japanese patent applications, H11-077115 filed on Mar. 23, 1999 and the contents of which is incorporated herein by reference.

BACKGROUND OF THE INVENTION

1. Field of the Invention

The present invention relates to a game machine for executing game processing by controlling a hit probability and controlling an attached equipment by a program control using a microcomputer.

2. Related Art

Conventionally, as game machines of this kind, there are, for example, flipped ball game machines using flipped balls for game media such as a pachinko machine (pin ball machine), a smart ball game machine and an arrange ball game machine and a slot machine using coins for game media. In recent years, microcomputers are adopted in such respective game machines and game processings of the respective game machines are carried out by program control using the microcomputers. A hit in respective game is produced under a previously programmed probability and an attached equipment such as rotary reels are strictly controlled by the program using the microcomputer.

However, decades ago, such respective game machines are constituted in a mechanical type and game processings are hardly dependent on the program control of the microcomputer as in game machines in recent years. Therefore, according to the game machines decades ago, an individual difference is caused even in the same game machines by an error in fabrication, ageing changes or wear of mechanical parts and there is a delicate variation in game operation depending on individual game machines.

All of game operation in such a game machine having a gamble aspect is carried out by a determination derived from feeling or hunch of a player himself from past to everlasting future. One of the basis of the determination is borne by compatibility between a player and a machine body similar to preference to the machine body (game machine). A player intends to select a compatible machine body in conformity to feeling of the player of the day as in having a conversation with a dealer in a casino. The compatibility is determined by the above-described delicate variation provided to the individual game machine.

However, according to the game machines in recent years in which the machine is controlled by a program, a hit probability is easy to control, on the other hand, there is almost no individual difference provided to game machines decades ago. Therefore, game machines of the same machine kind give only the same impression even when any of them is played and no specific machine body is attached to by a player.

Therefore, conventionally, when there is not found a compatible machine body in a certain machine kind of a game machine, in searching for a compatible machine body, a game machine of other machine kind having a different game aspect is obliged to select. As a result, attachment or preference of a player to a machine or a game is necessarily difficult to give, which is devoid of interest of game.

SUMMARY OF THE INVENTION

The invention has been carried out to address such a problem and according to an aspect of the invention, there is provided a game machine for executing a game processing while controlling a hit probability and controlling an attached equipment by a program control using a microcomputer, wherein the game machine comprises control means for not changing a control of the hit probability and changing a control of the attached equipment in accordance with individuals of the game machines to thereby produce an individual difference among the game machines of a same machine kind.

By changing control of the attached equipment by the control means of the constitution in accordance with the individuals, the individual difference is produced even with machines of the same machine kind and a delicate variation is produced in game operation by the individual game machine.

Therefore, the individual difference provided to a game machine of decades ago is produced among the machine bodies and attachment or preference of the player with regard to a machine or a game is newly produced to thereby enhance interest of play.

Such a control can easily be carried out by setting control constants used in controlling the attached equipment stored to a storage apparatus of the control means by values which differ depending on the individuals, for example.

DESCRIPTION OF THE PREFERRED EMBODIMENT

An explanation will be given of an embodiment in which a play machine according to the invention is applied to a slot machine as follows.

Figure 1:
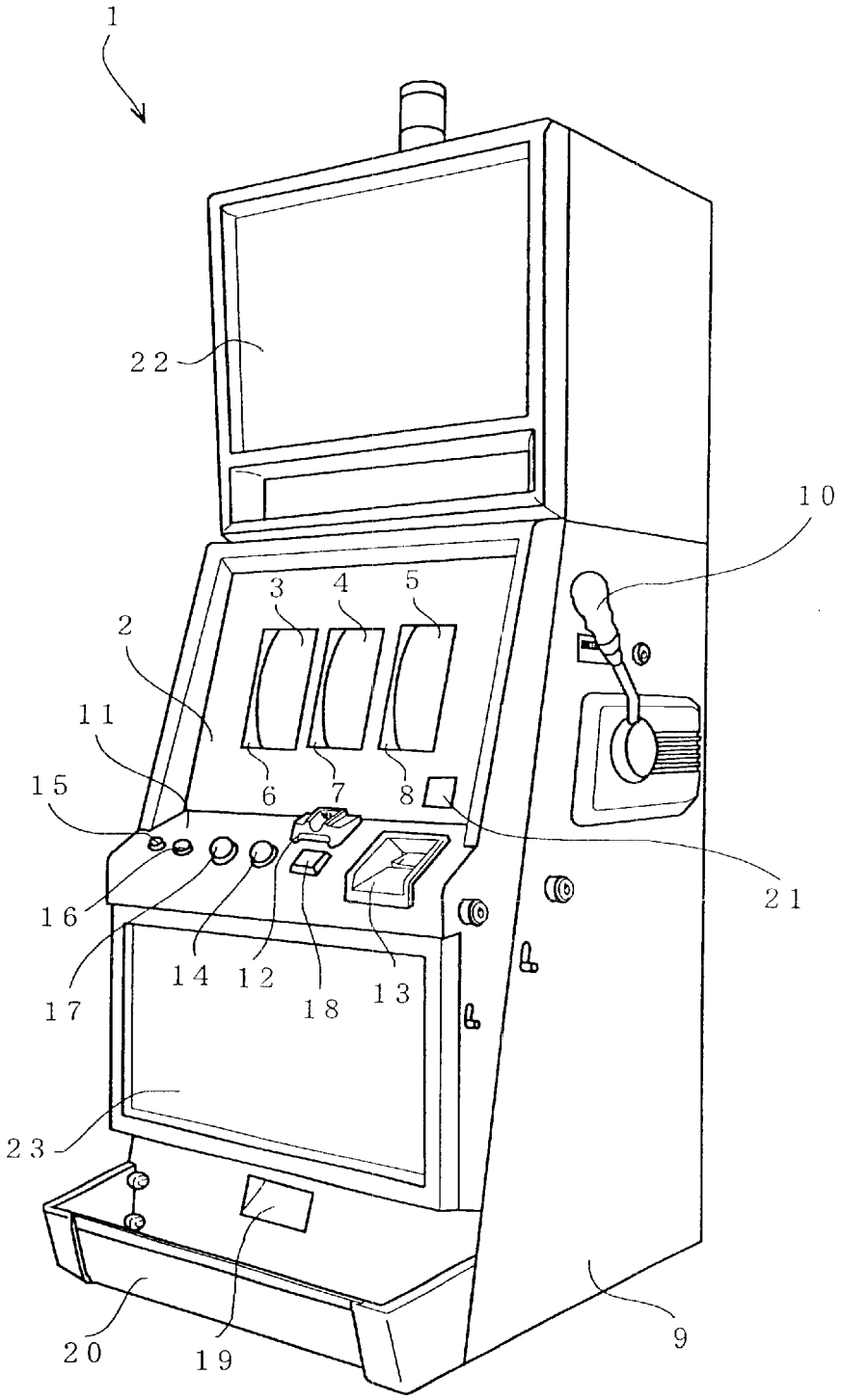
FIG. 1 is a perspective view showing an outlook of a slot machine according to an embodiment of the invention.

FIG. 1 is a perspective view of a slot machine 1 according to the embodiment.

Three of reels 3, 4 and 5 constituting a variable display apparatus are rotatably provided on the rear side of a reel glass 2 formed on the front face of the slot machine 1. Symbol columns comprising a plurality of kinds of picture patterns (hereinafter, referred to as symbol) are illustrated on outer peripheral faces of the respective reels 3, 4 and 5. Respective threes of the symbols are observed through display windows 6, 7 and 8 on the front face of the slot machine 1. The reels 3, 4 and 5 start rotating by operating a handle 10 provided on a side face of a cabinet 9.

Further, a coil entry 12 in which a player puts coins and a bill entry 13 for inserting paper money are provided at a control panel 11 disposed below the reel glass 2. Further, the control panel 11 is provided with a spin switch 14 for starting to rotate the reels 3, 4 and 5 by push button operation separately from operation of the handle 10 and is further provided with a change switch 15, a cash out switch 16, a bet 1 switch 17 and a max bet switch 18.

Whether coins gained by a player are paid to a coin tray 20 via a coin payment output 19 or stored at inside of the machine as credit, is switched by the change switch 15. A number of coins credited to inside of the machine is displayed at a display portion 21 constituted by 7 segment LEDs (Light Emitting Diode). By operating the cash out switch 16, credited coins are paid to the coin tray 20 by push button operation. By operating the bet 1 switch 17, only one sheet of credited coins is betted on the game by one push button operation. By operating the max bet switch 18, a maximum number of sheets of coins capable of being betted on one game is betted on the game by one push button operation.

Further, there is shown an allotment display table indicating how much coins are paid to hits is displayed on a top glass 22 above the reel glass 2 and a bottom glass 23 below the reel glass 2 is illustrated with characters or the like of the game machine.

Figure 2:
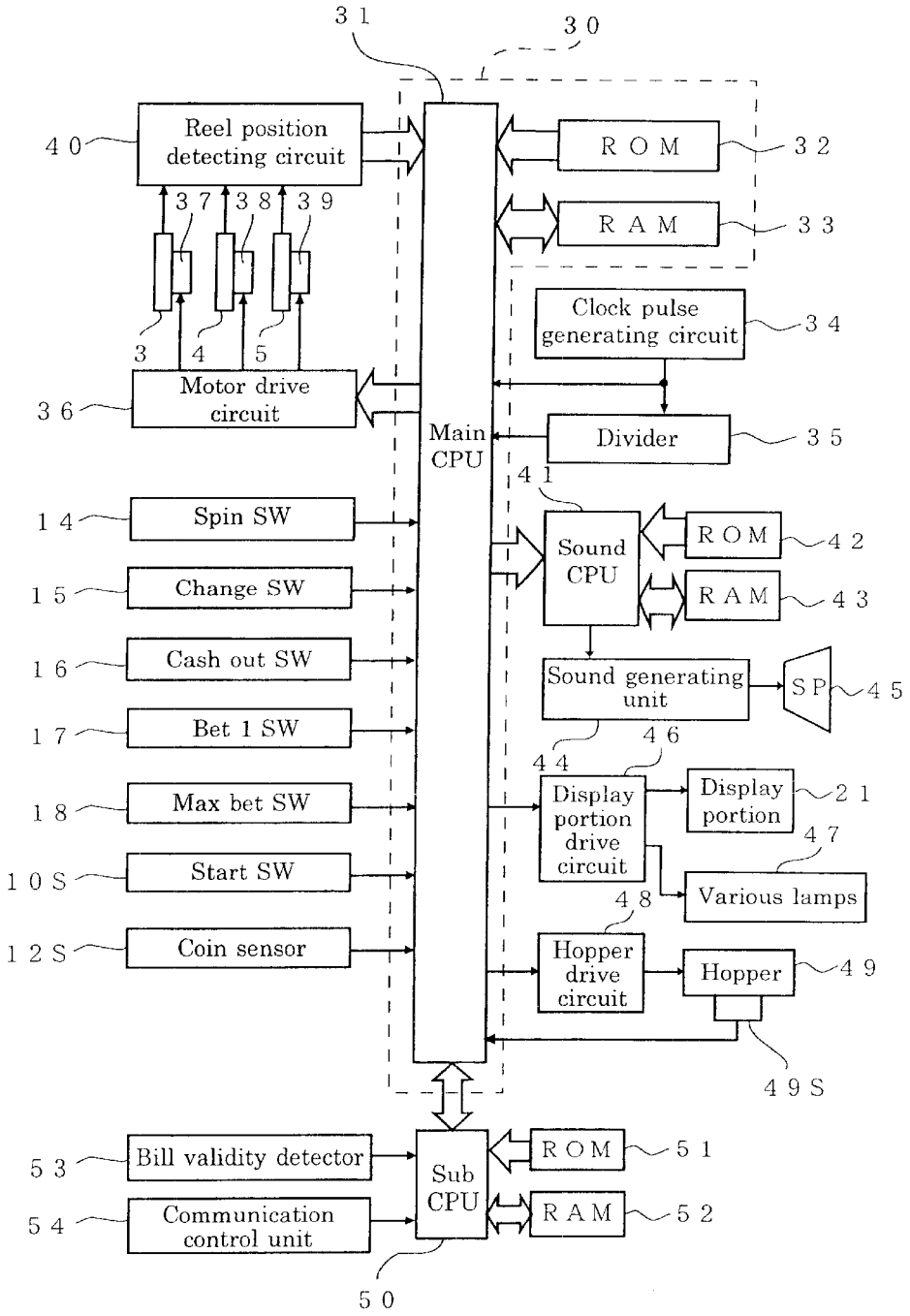
FIG. 2 is a block diagram showing an essential constitution of a control circuit of the slot machine according to the embodiment.

FIG. 2 shows a circuit constitution including a control unit for controlling game processing operation in the slot machine 1 of the embodiment and an attached equipment (actuators) electrically connected thereto.

The control unit is constituted by a microcomputer (hereinafter, referred to as micon) 30 as a principal constituent element and the micon 30 is constituted to include a main CPU 31 executing control operation in accordance with previously set programs, a ROM (Read Only Memory) 32 and a RAM (Random Access Memory; readable and writable memory) 33 which are storage means. The ROM 32 is stored with a control processing procedure of a total of the game machine as a program and is stored with control constants used in controlling the attached equipment. The RAM 33 is used as a temporary storage work area when the program is executed.

Further, the CPU 31 is connected with a clock pulse generating circuit 34 for generating reference clock pulses and a divider 35 which are necessary for operating the CPU 31. The divider 35 generates interruption pulses for interrupting and executing programs.

The CPU 31 is connected with a start switch 10S and a coin sensor 12S other than the respective switches 14 through 18, mentioned above. The start switch 10S generates a signal of starting the reels 3 through 5 when a player operates the handle 10 and is made ON or OFF in connection with operation of the handle 10. The coin sensor 12S detects proper coins inputted from the coin entry 12 and selected by a coin selecting apparatus.

Further, a motor drive circuit 36 connected to the CPU 31 controls respective stepping motors 37, 38 and 39 for driving to rotate the reels 3, 4 and 5 and a reel position detecting circuit 40 detects rotational positions of the respective reels 3, 4 and 5 and outputs the detected rotational positions to the CPU 31.

Further, the CPU 31 is connected with a sound CPU 41 and the sound CPU 41 controls a sound generating portion 44 in accordance with pro grams and control constants stored to a sound ROM 42 and outputs various game sounds from a speaker 45 as effective sounds. A sound RAM 43 is used as a temporal storage work area in processing to control the sound CPU 41. The sound generating unit 44 and the speaker 45 constitute a game sound generating apparatus.

Further, the CPU 31 is connected with a display portion drive circuit 46 and a hopper drive circuit 48 and the display portion drive circuit 46 controls to light the display portion 21, mentioned above, and various lamps 47. The hopper drive circuit 48 drives a hopper 49 in paying coins and pays coins contained in the hopper 49 to the coin tray 20. Paid coins are detected by a paid coin sensor 49S and a number of detected coins is given to the CPU 31. The hopper drive circuit 48, the hopper 49 and the paid coin sensor 49S constitute a game media paying apparatus.

Further, the CPU 31 is connected with a sub CPU 50 and the sub CPU 50 controls a bill validity detector 53 and a communication control unit 54 in accordance with programs and control constants stored to a ROM 51. A RAM 52 is used as a temporal storage work area in control processings by the CPU 50. The bill validity detector 53 detects paper money inserted into the bill entry 13 and the communication control unit 54 controls communication with a host computer of a game center.

Next, an explanation will be given of an outline of operation of the play machine controlled by the micon 30 according to the embodiment in reference to a flowchart of FIG. 3 as follows.

Figure 3:
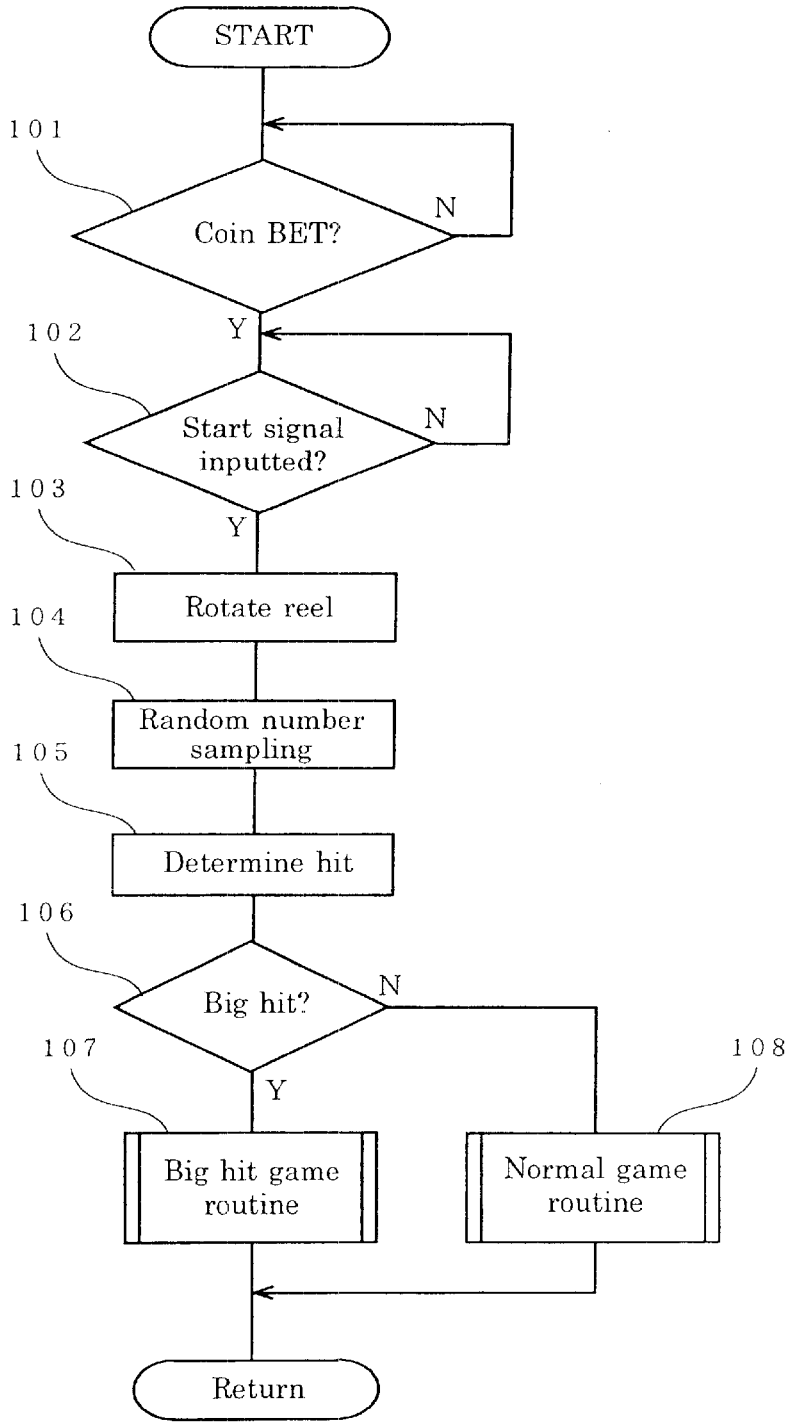
FIG. 3 is a flowchart showing an outline of play processings of the slot machine according to the embodiment.

First, the CPU 31 determines whether coin BET is carried out (FIG. 3, step 101). The determination is "YES" when coins are put into the coin entry 12 and a detected signal is inputted from the coin sensor 12S or when a signal is inputted from the bet 1 switch 17 or the max bet switch 18. In that case, successively, the operation determines whether a start signal is inputted from the start switch 10S or the spin switch 14 (step 102).

When the determination is "YES", the CPU 31 drives to rotate the reels 3 through 5 by transmitting a drive signal to the motor drive circuit 36 (step 103) and executes random number sampling (step 104). The random number sampling is executed by storing to the RAM 33, a numerical value produced by adding a predetermined number (for example, 3) to one integer in a predetermined range (for example, 0 through 127) generated from an R resistor in the CPU 31 at each time of inputting the reference clock pulse from the clock pulse generating circuit 34 and reading the numerical value stored to the RAM 33 at each time of executing operation by interruption. Further, the numerical value stored to the RAM 33 is updated at each time of inputting the reference pulse.

Next, the operation executes hit determination based on the random number value sampled as described above (step 105). The hit determination is executed by comparing a hit probability table previously stored in the ROM 32 with the sampled random number value and a flag in accordance with a result of the hit determination (for example, indicating hit or miss) is erected in the RAM 33. Further, the operation determines whether a result of the hit determination at current time is a big hit (step 106), executes a big hit game routine in the case of "YES" (step 107) and executes a normal game routine in the case of no big hit (step 108). Although a player can generally gain a large number of coins in a big hit game, a number of gained coins is small in a normal game.

In this way, according to the slot machine 1 for executing the program control using the microcomputer, there is carried out the control of hit probability in the random sampling at step 104 and the hit determination at step 105 and a total coin payment rate in, for example, business hours of a day is maintained substantially constant. The slot machine 1 according to the embodiment is provided with control means for individually changing control of the attached equipment to produce individual difference without changing such a control of the hit probability among game machines of the same machine kind.

The control means is constituted by the main CPU 31 having the ROM 32 and the RAM 33, the sound CPU 41 having the sound ROM 42 and the sound RAM 43 and the sub CPU 50 having the ROM 51 and the RAM 52. Control constants stored to respective the ROM 32, 42 and 51 and used for controlling the respective attached equipment are set to values which differ according to individuals of the game machine and individually difference is produced among the respective game machines by controlling the respective attached equipment by using the control constants by respective the CPU 31, 41 and 50.

For example, when the attached equipment is constituted by the reels 3 through 5 for variably displaying various symbols, the ROM 32 stores control constants for determining timings of starting to rotate the respective reels 3 through 5 or stopping to rotate thereof by values which differ by the individuals. By controlling to rotate the respective reels 3 through 5 by reading the control constants by the CPU 31, for example, only the left reel 3 of a certain machine body starts rotating retardedly although the machine body is of a machine of the same machine kind. Further, only the central reel 4 of a certain machine body stops rotating retardedly or only the reel 4 stops rotating after the reel 4 has rotated further by one rotation.

Further, when the attached equipment is constituted by the switches 14 through 18 for controlling operation of the game machine, the RAM 32 stores control constants for determining operational timings in response to operation of the respective switches 14 through 18 by values which differ by the individuals. The CPU 31 reads the control constants and executes operational control in correspondence with operation of the respective switches 14 through 18 and changes response timings with regard to respective switching operations depending on individuals.

For example, when the bet 1 switch 17 is operated, with regard to only a certain machine body, a lamp having a built-in switch is not immediately lighted but the lamp is delayed to light by one beat. Further, a number of credit displayed on the display portion 21 is also delayed to reduce by one beat. Further, with regard to only a certain machine body, even when the spin switch 14 is operated, the reels 3 through 5 are not rotated immediately but are delayed to start rotating. Further, with regard to only a certain machine body, even when the cash out switch 16 is operated, payment is not carried out immediately but the payment is delayed.

Further, when the attached equipment is the game media paying apparatus, the ROM 32 is stored with control constants for determining a speed of paying coins or a timing of paying thereof from the hopper 49 by the hopper drive circuit 48 by values which differ depending on the individuals. The CPU 31 reads the control constants, executes a control of paying coins by the hopper drive circuit 48 and changes the speed of paying coins paid to the coin tray 20 or the timing of paying thereof in accordance with the individuals. For example, with regard to only a certain machine body, the paying speed is extremely delayed or with regard to only a certain machine body, the payment is temporarily stopped and the payment is executed again after a while even when the machine body is of the same machine kind.

Further, when the attached equipment is the game sound generating apparatus, the sound ROM 42 stores control constants for determining a sound emitting speed or a sound emitting timing of the game sound generating apparatus by values which differ depending on the individuals. The sound CPU 41 reads the control constants and executes a control of emitting sound from the speaker 45 by the sound generating unit 44 and changes the sound emitting speed or the sound emitting timing depending on the individuals. For example, with regard to only a certain machine body, sound in rotating the reels 3 through 5 is emitted while being delayed from a timing of starting to rotate the reels 3 through 5 or only with regard to a certain machine body, the sound in rotating the reels is stopped earlier than a timing of stopping the reels 3 through 5. Further, even when a hit is produced by arranging a predetermined combination of symbols on an effected hit line, with regard to only a certain machine body, the effective sound of hit is not emitted immediately but the effective sound of hit is emitted while being delayed by one beat or the effective sound of hit is emitted at an unhurried speed.

Such a individual difference is made similar to the individual difference produced by a product error of a game machine decades ago, a reaction of indeed a mechanical control is programmed intentionally and is written to a base program (OS) of one ROM as a variation. Further, several kinds of variations may be written to one base program by combining kinds of the respective individual differences, mentioned above. However, as mentioned above, the program has nothing to do with the hit probability of game and a game machine of the same machine kind is persistently provided with the same hit probability, further, provided with an outlook of the same game machine. Therefore, a player cannot discriminate the variation from the outlook.

By preparing, for example, 10 kinds of ROMs having such variations and mixing them into respective machine bodies of an island of 100 of game machines uniformly or deviatedly, there can be provided variations which differ between contiguous machine bodies or opposed machine bodies even in a game machine island of the same machine kind. Therefore, a player can find and play with machine bodies having different compatibilities from the game machine island of the same machine kind. The player can play game with different compatibilities of game aspects preferred by the player and accordingly, when a game machine is not satisfactory to the player, the player may change the game machine and when a game machine selected by the player, that is, a variation thereof is satisfactory to the player, the player can stick thereto.

Therefore, the player can play game for a long period of time without losing interest and accordingly, the operational rate of the game machine is promoted and general coin-in, that is, the sale of the game center can be increased. Further, the player is prevented from moving to a game machine island of other game machine maker by the feeling of the player and accordingly, the player plays game for a long period of time by the game machine of one maker, as a result, evaluation of brand of the company is also promoted.

Further, although according to the above-described embodiment, an explanation has been given of the case in which the invention is applied to the slot machine, the invention is similarly applicable to flipped game machines of a pachinko machine, a smart ball game machine and an arrange ball game machine which are program-controlled. Also in such respective cases, an effect similar to that in the above-described embodiment is achieved.

Although the present invention has been explained in reference to the embodiments, it is apparent for those skilled in the art that many changes and modifications can be made without departing from the spirit and scope of the invention, as clear from the following claims.

What is claimed is:

1. A game machine for executing a game processing while controlling a hit probability and attached equipment by a program control using a microcomputer, wherein said game machine comprises:

control means, which includes a storage apparatus for storing control constants, used in controlling the attached equipment, and is previously set prior to game machine operation to values, which differ in individual game machines and do not vary during the game machine's operation, for changing the program control of the attached equipment in accordance with the control constants of the individual game machines to thereby produce different gaming variations among game machines of a same machine kind, while not changing the program control of the hit probability among the game machines of a same machine kind.

2. The game machine of claim 1, wherein the attached equipment is a variable display apparatus for variably displaying various picture patterns, the storage apparatus stores the control constants for determining a timing of starting a variable display or stopping the variable display of the variable display apparatus, and the control means executes to control the variable display of the variable display apparatus by reading the control constants and changing the timing of starting the variable display or stopping the variable display of the variable display apparatus depending on the individual game machine.

3. The game machine of claim 1, wherein the attached equipment is a switch for controlling operation of the game machine, the storage apparatus stores the control constants for determining an operation timing in response to operating the switch as values which differ depending on the individual game machines, and the control means executes an operation control in response to operating the switch by reading the control constants and changing a reaction timing in response to operating the switch of the game machine.

4. The game machine of claim 1, wherein the attached equipment is an apparatus of paying game media, the storage apparatus stores the control constants for determining a speed of paying or timing of paying of the apparatus of paying game media as values which differ depending on the individual game machines, and the control means executes a payment control of the apparatus of paying game media by reading the control constants and changing the paying speed or the paying timing of the apparatus of paying game media of the individual game machine.

5. The game machine of claim 1, wherein the attached equipment is an apparatus of generating a game sound, the storage apparatus store the control constants for determining a sound emitting speed or a sound emitting timing of the game sound generating apparatus as values which differ depending on the individual game machine, and the control means executes a sound emitting control of the game sound generating apparatus by reading the control constants and changing the sound emitting speed or the sound emitting timing of the game sound generating apparatus of the individual game machine.

6. The game machine of claim 1, wherein the game machine is a slot machine or a flipped ball game machine.

* * * * *